United States Patent [19]

Agneta

[11] 4,232,311

[45] Nov. 4, 1980

[54] COLOR DISPLAY APPARATUS

[75] Inventor: Roi D. Agneta, Fort Salonga, N.Y.

[73] Assignee: Chyron Corporation, Melville, N.Y.

[21] Appl. No.: 22,133

[22] Filed: Mar. 20, 1979

[51] Int. Cl.[2] ..... G06F 3/14

[52] U.S. Cl. ..... 340/703; 340/701; 340/707; 340/709; 340/751; 358/81

[58] Field of Search .....340/701, 703, 707, 709, 340/748–750, 732, 751; 358/81

[56] References Cited

U.S. PATENT DOCUMENTS

| | | | |
|---|---|---|---|
| 3,798,363 | 3/1974 | Melchior | 340/707 |
| 3,846,826 | 11/1974 | Mueller | 358/81 |
| 3,995,312 | 11/1976 | Hubbard, Jr. et al. | 358/81 |
| 3,997,891 | 12/1976 | Iwamura et al. | 340/707 |
| 4,025,946 | 5/1977 | Casey | 358/81 |
| 4,139,862 | 2/1979 | Haskell et al. | 358/81 |
| 4,146,880 | 3/1979 | Arizabalaga | 340/707 |
| 4,149,184 | 4/1979 | Giddings et al. | 340/703 |
| 4,149,185 | 4/1979 | Weinger | 358/81 |
| 4,150,364 | 4/1979 | Baltzer | 340/707 |

FOREIGN PATENT DOCUMENTS

| | | | |
|---|---|---|---|
| 2035497 | 2/1971 | Fed. Rep. of Germany | 358/81 |

OTHER PUBLICATIONS

*Use of a Simple Light Pen System with Color TV Image Analyser;* Stanton et al.; Med. & Biol. Eng.; vol. 13 #2; pp. 311–314, Mar. 1975.

*Achieving a Colored Image Display from Images Lacking Specified Color Content,* Giddings et al.; IBM Tech. Discl. Bull., vol. 18 #7; pp. 2300–2301; Dec. 1975.

*Primary Examiner*—Marshall M. Curtis

*Attorney, Agent, or Firm*—Hane, Roberts, Spiecens & Cohen

[57] ABSTRACT

A color display system has a color encoder which receives intensity signals via a video generator from a graphics generator as well as color signals. The color encoder processes the color and video signals for transmission to a display monitor which then displays the graphics in color. Such a system is provided with apparatus for selecting from a palette set of colors a working subset of the color signals for use in the display of colored graphics. The apparatus includes a palette memory for storing sets of groups of indicia wherein each of the groups of indicia represents a different color signal of the set. Means are provided for sequentially transferring the groups of indicia from the palettememory to the display monitor for displaying the colors associated with the groups. A working memory stores a subset of groups of indicia. Selection means transfer from the palette memory to the working memory groups of indicia in accordance with the desired colors displayed on the display monitor.

5 Claims, 1 Drawing Figure

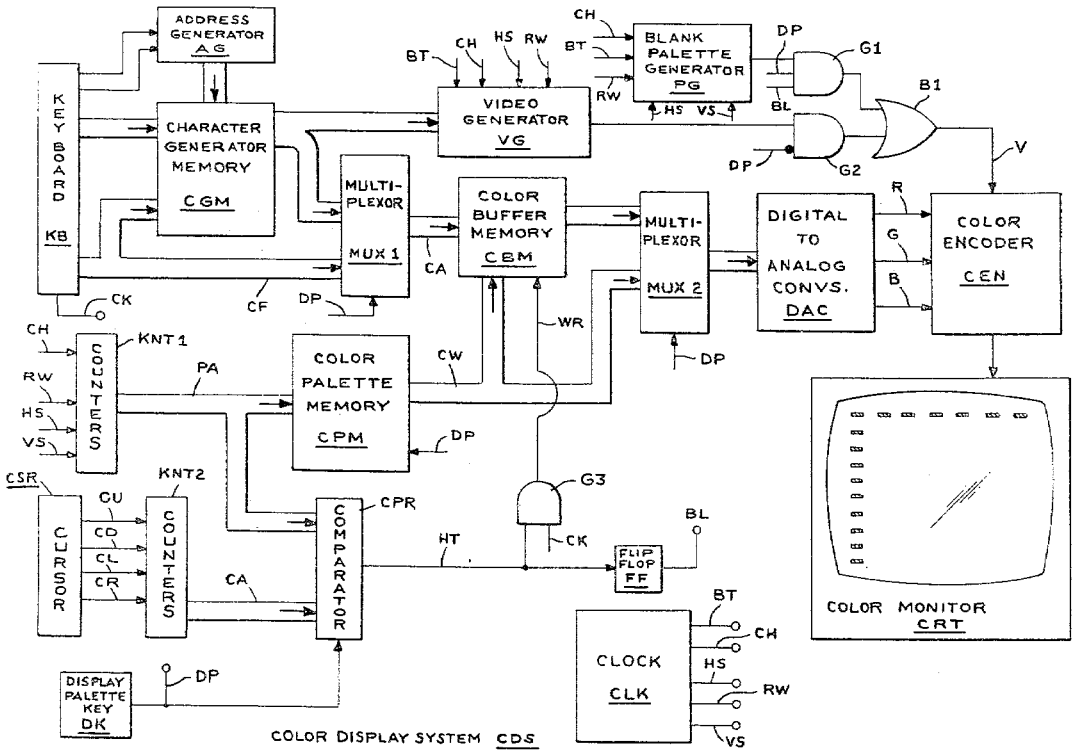

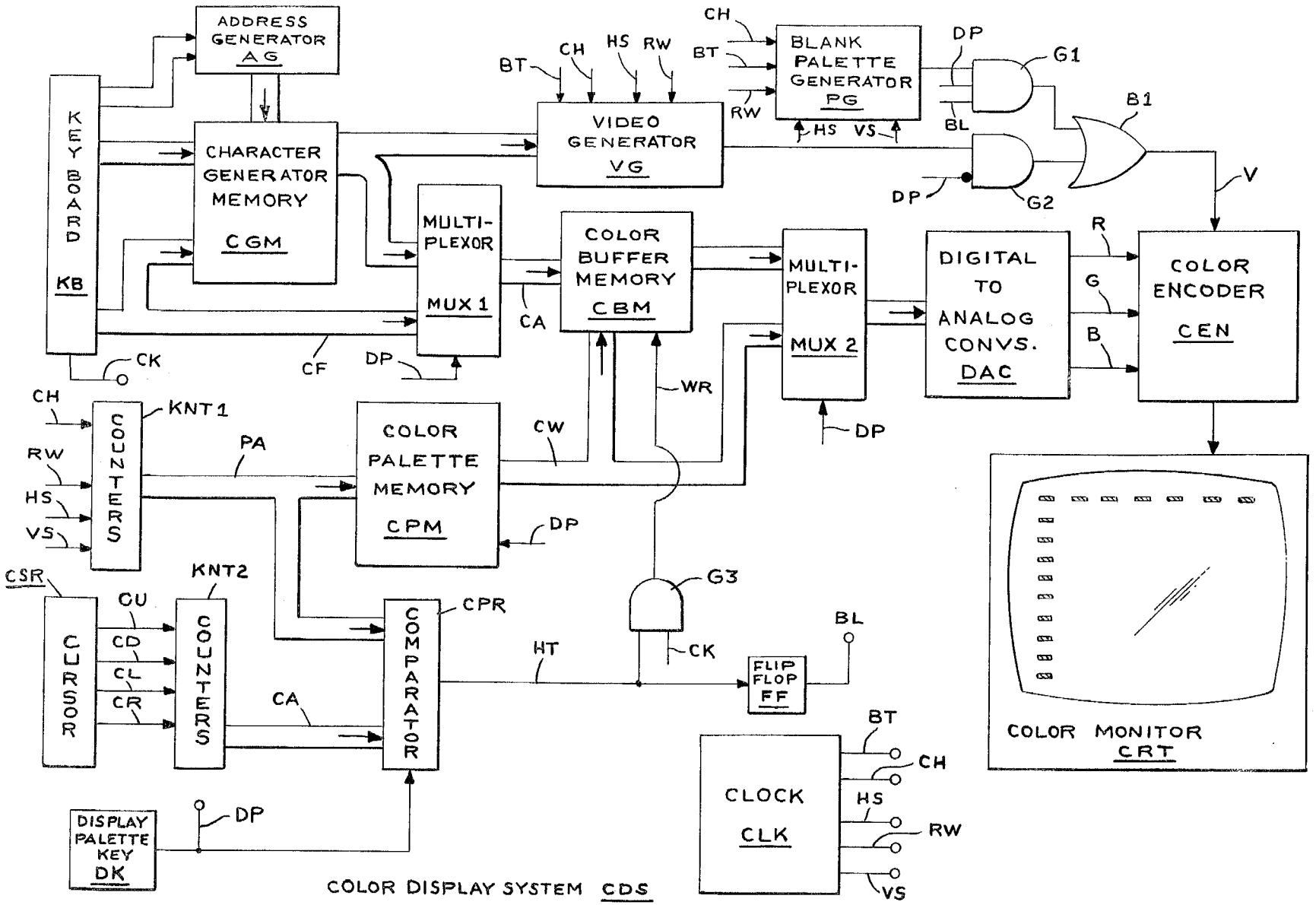
COLOR ENCODER CEN
COLOR MONITOR CRT
DIGITAL TO ANALOG CONVS. DAC
MULTI-PLEXOR MUX 2
BLANK PALETTE GENERATOR PG
VIDEO GENERATOR VG
COLOR BUFFER MEMORY CBM
MULTI-PLEXOR MUX 1
COLOR PALETTE MEMORY CPM
COMPARATOR
FLIP FLOP FF
CLOCK CLK
ADDRESS GENERATOR AG
CHARACTER GENERATOR MEMORY CGM
KEY BOARD KB
SEMAPHORE
CURSOR
DISPLAY PALETTE KEY DK
COLOR DISPLAY SYSTEM CDS
V
B1
G1
G2
G3
R
G
B
DP
BL
CH
BT
RW
HS
VS
WR
CA
CW
CF
CPR
HT
CK
PA
KNT1
KNT2
CU
CD
CL
CR
CSR

COLOR DISPLAY APPARATUS

BACKGROUND OF THE INVENTION

This invention pertains to graphic generators and more particularly to character generators which can generate characters in color.

There are many uses for character generators such as in the photo-typesetting field and as titleing means in the television industry. In most such systems a cathode ray tube is driven in a raster or similar scan and during this scan is intensity-modulated to create the characters or symbols or the like. Such devices have been very successful leading to those of like construction which have the added versatility of displaying the graphics in a group of colors. Heretofore the group of colors has been limited to a range associated with the capacity of a working memory. This capacity usually is in the range of about 8 colors. While this range is satisfactory for many applications it actually limits the artistic freedom of the graphics designer. Accordingly, there is a demand for giving to such designer a full gamut of colors from which to select.

SUMMARY OF THE INVENTION

Briefly, the invention contemplates a color display system wherein a graphic is displayed in color in response to indicia representing the graphic and other indicia representing the color of the graphic. In such a system indicia representating colors for the graphics to be displayed is selected by storing a plurality of sets of indicia each set representing a different color of a palette of colors. There is displayed in response to each set of indicia a color patch. While these color patches are being displayed selected ones of the color patches are chosen to establish a subset of working colors. As each color patch is chosen there is stored the set of indicia associated therewith in a register of an address memory. Thereafter when assigning a working color to a graphic to be displayed, the address of the register containing the indicia associated withe the assigned color is coupled to the indicia associated with the particular graphic so that the indicia representing the color of the graphic to be displayed is obtained from the address memory.

BRIEF DESCRIPTION OF THE DRAWING

Other objects, the features and advantages of the invention will be apparent from the following detailed description when read in conjunction with the accompanying drawing whose sole FIGURE shows a color display system incorporating the invention.

DESCRIPTION OF THE PREFERRED EMBODIMENT

In the sole FIGURE the color display system CDS includes a conventional color television monitor CRT which is driven by a conventional color encoder CEN. The color encoder CEN receives the luminance signal on line V and the color signals for red, green and blue respectively on lines R, G, and B and combines these signals in the usual manner to form the usual color video signal.

During normal operations the codes for a page of characters which are stored in character generator memory CGM are sequentially read out therefrom for display. Each code has two fields. One field gives, say, the ASCII code for the actual character shape and the other field, say, of three bits, gives the code for the color of the character. The ASCII code is fed to video generator VG which translates the code into intensity-modulated signals representing the plurality of bars, dots or the like used in forming the character. These signals are fed via AND-circuit G2 and OR-circuit B1 to line V. At the same time, the three-bit code representing the color is fed as an address, via multiplexor MUX1, to color buffer memory CBM. Color buffer memory CBM at this time will be storing, the indicia for eight working colors. Thus the momory has eight addressed registers. Each register comprises three two-bit fields. Each field is associated with one of the colors red, green and blue and since it is two-bits wide the number stored therein represents one of four levels of color intensity. Thus addressed memory CBM emits a coded combination of bits representing a mixture of three primary colors. This combination is fed, bits in parallel, to three conventional digital-to-analog converters DAC which receive respectively the three fields. Upon conversion of these three fields, three analog signals representing intensity of the colors red, green and blue are fed to the color encoder CEN to "color" the "character" then being transmitted to the color monitor CRT.

The gist of the invention concerns being able to vary the "colors" stored in color buffer memory CBM so as to give a designer more colors to work with.

The system is switched to the palette mode by operating the display palette key DK. In this mode color monitor CRT displays an eight-by-eight matrix of color "patches" or squares to make available the choice of eight colors from a palette of sixty four colors. The sixty four colors are formed by all possible combinations of the four different intensities of the three primary colors.

Accordingly, there is provided a color palette memory which can be a sixty four word addressable member wherein each word comprises three two-bit fields. The memory is continuously sequentially addressed by counters KNT1 which count row and character pulses from clock CLK in synchronism with the raster generated on the monitor CRT.

In the palette mode the signal on line DP actively connects the output register of the memory to the cable CW and the color code words are fed via multiplexor MUX2 and digital to analog converters DAC to color encoder CEN. At the same time line V receives an intensity modulation signal encoded such that an eight-by-eight array of boxes is displayed on the monitor. Thus can be accomplished by programming the video generator VG to emit blank symbols or by utilizing a separate blank palette generator PG.

In essence the blank palette generator PG can be a flip-flop which is turned on by each CH pulse and turned off a number of bit times thereafter. The output of this flip-flop is further controlled by the RW, HS and VS signals in a conventional manner to synchronize it with the raster of the monitor. In the palette mode the output of the generator PG passes via AND-circuit G1 and OR-circuit B1 to line V. Note during this mode the signal on line DP is present at the inhibiting input of AND-circuit G2, thus blocking signals from video generator VG. In this manner the full set of colors of the palette is displayed.

The cursor system is used to choose from this array the eight working colors. In particular there is provided a cursor CSR which can be a set of four keys, each having the property of emitting a single pulse when momentarily depressed. The keys are related to the movement of a displayed indicator on the monitor screen. Depressing a first of the keys results in a pulse of line CU calling for the indicator to be moved one row upward; and the depression of a second key yields a pulse on line CD calling for the indicator to be moved one row downward. Similarly, the third and fourth keys result in pulses on lines CL and CR respectively calling for indicator movement and character left or right respectively. The lines CU and CD are connected to the up and down count inputs, respectively, of a conventional modulo-8 up down counter, while the lines CL and CR are connected to the up and down count inputs, respectively, of another conventional modulo-8 up down counter. The outputs of the counters form the desired address of the cursor. This desired address from counters KNT2 is compared with the addresses being sequentially generated by counters KNT1 by conventional comparator CPR which emits a pulse on line HT whenever equality is sensed. Line HT is connected to the toggle input of flip-flop FF which changes state each time it is pulsed. Note also that there is a pulse per raster field or twice per frame. Thus the signal on line BL changes state twice per frame. This signal is fed to an input of AND-circuit G1 to, in effect, cause field rate "blinking" of the selected patch. By using the cursor keys the blink can be moved to a color desired for the working subset.

Assume, the first working color is to be selected. The keyboard in addition to having symbol keys has, for example, eight color keys. Whenever one of these keys is depressed it generates a three bit address for the eight registers of the color buffer memory CBM. Thus, when the first color key is depressed with a particular color patch blinking, the first register of memory CBM is accesssed by means of the signals on line CF, via multiplexor MUX1 and lines CA. (Note the signal on line DP opens this path). At that time the color code word on line CW which is generating the blinking color enters the addressed register by virtue of the write pulse on line WR. Line WR is pulsed whenever there is a coincidence of signals on line HT and line CK at AND-circuit G3. There is a pulse on line CK whenever any color key is depressed.

The second color is entered in the same manner by moving the cursor to the desired color patch and pressing the second color key. In this way eight working colors can be loaded.

Thereafter the display palette key DK is released and normal operations can proceed. In such case one loads the character generator memory CGM via the keyboard by stroking the desired character and color keys. Since this forms no part of the invention it will not be described.

It should be noted that whenever one wishes to change a working color, it is only necessary to return to the display mode move the cursor to the desired color, press the color key of the color to be replaced, and return to the normal mode.

The clock CLK which times the overall system generates pulses on line BT at the desired pixel rate. If dot matrix characters are used these pulses are divided down by a number equal to the width of the dot matrix to give the character pulses on line CH. The character pulses are further divided by the number of characters per line to give the horizontal sync pulses on line HS. These pulses are divided by a number related to the height of the characters to give the row pulses on line RW. The pulses on line RW are divided by the number of rows in a field to give the vertical sync pulses on line VS. These dividings are accomplished in a conventional manner by well known counter-chains.

While only one embodiment of the invention has been shown and described in detail there will now be obvious to those skilled in the art many modifications and variations satisfying many or all of the objects of the invention without departing from the spirit thereof as defined by the appended claims.

What is claimed is:

1. In a color display system wherein a graphic is displayed in color in response to indicia representing the graphic shape and other indicia representing the color of the graphic, the method of selecting indicia representing colors for graphics to be displayed comprising the steps of storing a plurality of sets of indicia, each set representing a different color of a palette of colors, displaying in response to each set of indicia a color patch, selecting different color patches to establish a subset of working colors and in response to the selection of each color patch storing the set of indicia associated therewith in a register of an addressed memory, and thereafter, when assigning a working color to a graphic to be displayed, coupling to the indicia associated with the graphic the address of the register containing the indicia associated with the assigned working color so that the indicia representing the colors of the graphic to be displayed is obtained from the addressed memory.

2. In a color display system having a color encoder which receives intensity signals via a video generator from a graphics generator memory and color signals, the color encoder processing the color and video signals for transmission to a display monitor, apparatus for selecting from a palette set of color signals a working subset of the color signals for use in the display of colored graphics, said apparatus comprising palette memory means for storing sets of groups of indicia, each of said groups of indicia representing a different color signal of said set, means for sequentially transferring the groups of indicia from said palette memory means to said display monitor for display of the colors associated with the groups, a working memory means for storing a subset of the groups of indicia and selection means for transferring from said palette memory means to said working memory means groups of indicia in accordance with desired colors displayed on the display monitor.

3. The apparatus of claim 2 wherein said selection means comprises keyboard means and cursor means for selecting in response to the colors on the display monitor which group of indicia is to be stored in said working memory.

4. The apparatus of claim 3 wherein said working memory comprises a plurality of addressed storage locations each capable of storing a group of said indicia, and said keyboard means comprising a plurality of key means, each of said key means when depressed transferring the address of a particular storage location to said working memory means so that the group of indicia associated with the displayed colors selected by said cursor means is transferred to said particular storage location.

5. The apparatus of claim 3 or 4 wherein said palette memory means comprises a plurality of addressed registers each storing a group of said indicia and first addressing means for sequentially addressing said register for serially transmitting the group of indicia to said display monitor; and wherein said cursor means comprises second addressing means for generating desired positions for a cursor on the display monitor and comparator means responsive to said first and second addressing means for transmitting signals representing visual cursor information to the display monitor.

* * * * *